US011371473B2

(12) United States Patent
Allemeersch

(10) Patent No.: US 11,371,473 B2
(45) Date of Patent: Jun. 28, 2022

(54) DEVICE FOR REDUCING FUEL CONSUMPTION OF AN ENGINE

(71) Applicant: Jean Marc Allemeersch, Richardmenil (FR)

(72) Inventor: Jean Marc Allemeersch, Richardmenil (FR)

( * ) Notice: Subject to any disclaimer, the term of this patent is extended or adjusted under 35 U.S.C. 154(b) by 241 days.

(21) Appl. No.: 16/492,123

(22) PCT Filed: Feb. 22, 2018

(86) PCT No.: PCT/FR2018/050415
§ 371 (c)(1),
(2) Date: Sep. 7, 2019

(87) PCT Pub. No.: WO2018/154241
PCT Pub. Date: Aug. 30, 2018

(65) Prior Publication Data

US 2021/0172405 A1 Jun. 10, 2021

(30) Foreign Application Priority Data

Feb. 24, 2017 (FR) ..... 17305201

(51) Int. Cl.
*F02M 27/04* (2006.01)
*F23K 5/08* (2006.01)

(52) U.S. Cl.
CPC ..... *F02M 27/04* (2013.01); *F23K 5/08* (2013.01); *F02M 2027/047* (2013.01); *F23K 2300/101* (2020.05)

(58) Field of Classification Search
CPC .... F02M 27/04; F02M 2027/047; F23K 5/08; F23K 2300/101; Y02T 10/12; H01F 5/06; H01F 5/02; H01F 7/20; F02B 51/04
See application file for complete search history.

(56) References Cited

U.S. PATENT DOCUMENTS

| | | | | |
|---|---|---|---|---|
| 3,976,726 | A | 8/1976 | Johnson | |
| 5,080,080 | A | 1/1992 | Melendrez | |
| 5,271,369 | A | 12/1993 | Melendrez | |
| 2014/0202864 | A1 * | 7/2014 | Hasegawa | F02M 27/02 204/557 |

FOREIGN PATENT DOCUMENTS

| | | | |
|---|---|---|---|
| EP | 2631461 | A1 | 8/2013 |
| JP | 2003301748 | A | 10/1995 |
| JP | H07259666 | A | 10/1995 |
| JP | 2008101595 | A | 5/2008 |
| JP | 2009293577 | A * | 12/2009 |

(Continued)

*Primary Examiner* — Hung Q Nguyen
(74) *Attorney, Agent, or Firm* — Craft Chu PLLC; Andrew W. Chu

(57) ABSTRACT

The device for reducing the fuel consumption of a heat engine, in particular of a motor vehicle, includes a substantially tubular induction member mounted around a pipe which carries the fuel, in order to create an electromagnetic field therein from an AC current received from an electric power source. The induction member includes a sleeve arranged to hold a winding of wire connected to an electric power source. The sleeve is housed in a tubular shell ensuring that the device complies with electromagnetic compatibility standards.

8 Claims, 3 Drawing Sheets

(56) References Cited

FOREIGN PATENT DOCUMENTS

| | | | | |
|---|---|---|---|---|
| JP | 2009293577 | A | 12/2009 | |
| JP | 2014029227 | A | 2/2014 | |
| WO | 9314311 | A1 | 7/1993 | |
| WO | 0216024 | A1 | 2/2002 | |
| WO | WO-2008068409 | A2 * | 6/2008 | ..... F02M 27/04 |

* cited by examiner

DEVICE FOR REDUCING FUEL CONSUMPTION OF AN ENGINE

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a device for reducing the fuel consumption of an engine, in particular of a motor vehicle, of the type including an induction member with a substantially tubular shape intended to be mounted around a pipe in which fuel circulates, in order to create an electromagnetic field therein from an alternating current received from an electricity source.

More particularly, the device according to the invention may advantageously be applied to many types of engines and is thus suitable for the engines of heavy vehicles, agricultural and/or forest vehicles, construction vehicles, base stations or water vehicles powered by various fuels such as gasoline and/or diesel and/or all-season off-road gas oil (summer or winter extreme cold "GNR").

2. Description of Related Art Including Information Disclosed Under 37 CFR 1.97 and 37 CFR 1.98

Various solutions to improve the energy efficiency and decrease the fuel consumption of a heat engine have already been proposed, not only to enable savings, but also in order to limit the emissions into the environment of the harmful particles induced by the fuel consumption.

It has thus in particular been proposed to deposit, at the bottom of the fuel tank of a vehicle, before filling the latter, one or several soluble tablet(s) capable of releasing components which, by mixing with the fuel, impart properties to it making it possible to enhance the performance of the engine. However, this solution was not satisfactory in particular because its effectiveness assumes complete regularity in the use of the tablets, and any forgetfulness when filling up is detrimental in terms of results. Furthermore, in some cases, an untimely formation of blockages related to a crystallization of particles from the tablets could be observed in the pipes conveying the fuel.

Solutions, in particular described in publication U.S. Pat. No. 5,080,080 or in publication U.S. Pat. No. 5,271,369, based on the use of magnets integrated into the fuel supply circuit of an engine, and making it possible to produce a magnetic field therein, were also proposed. However, it was observed that they were not suitable for all commercially available types of fuel and that their implementation only causes a decrease in consumption with very specific fuels.

Also known from document WO 02/16024 is a device dedicated to decreasing the fuel consumption of a motor vehicle that is based on the implementation of several induction coils arranged around a supply pipe, and connected to an electricity source delivering an alternating current at a frequency of between 1.5 kHz and 60 kHz. Such a device nevertheless has the drawback of requiring installation during the manufacturing of the vehicle in question, or in case of later installation, of disassembling the pipe making it possible to insert it through the induction coils. Furthermore, it was shown that with certain types of fuel, no savings were obtained.

BRIEF SUMMARY OF THE INVENTION

The present invention primarily aims to propose a new solution for reducing the fuel consumption of a heat engine, this solution making it possible to overcome the aforementioned drawbacks, being effective with a wider range of fuels, having a structure that is both simple in order to limit the production costs, and practical to allow a quick assembly/disassembly. Another aim of the present invention is to procure such a device that, furthermore, in the context of a preferred non-limiting embodiment variant, has a structure such that its installation does not require any modification of the original fuel circuit.

To that end, the present invention relates to a device of the type indicated in the preamble, characterized in that said induction member includes a sleeve around which at least one wire coil is arranged connected to said electricity source, said sleeve being housed in a tubular shell designed to be capable of guaranteeing compliance with the standards on electromagnetic compatibility by said device.

According to one preferred embodiment variant of the invention, the sleeve can be provided with a helical furrow forming a number n of turns, and extending along at least its outer face.

Owing to such a structure, a close contact between the wire coil and the pipe in which the fuel circulates can be obtained after the installation of the device according to the invention, which makes it possible to guarantee a better effectiveness thereof.

According to one feature of the invention, said shell can be made completely from aluminum or incorporate a metal ring.

Thus, according to one conceivable embodiment variant, said metal ring can be housed between an inner enclosure and an outer enclosure of said shell.

Additionally, in this case, said outer enclosure can be made from a rigid plastic material while said inner enclosure can be made from a flexible plastic material.

Furthermore, according to one preferred embodiment variant of the device according to the invention, said sleeve and said shell include at least one longitudinal slit delimiting at least two longitudinal edges and are configured so as to be able to adopt an open position in which their two longitudinal edges are separated and a closed position in which their two longitudinal edges are close together.

Furthermore, the present invention also provides that said sleeve and said shell can include a longitudinal slot extending across from said longitudinal slit and defining a bending line allowing them to move between the closed and open positions.

According to another conceivable embodiment variant, said shell is made up of two half-shells connected to one another by at least one hinge.

Furthermore, at least two longitudinal edges of said shell and/or of said sleeve can advantageously include complementary nesting means allowing a better fit of the device according to the invention on the considered fuel pipe.

In this regard, it is also provided that at least two longitudinal edges of said shell can include means for locking of the latter in the closed position.

According to one conceivable embodiment variant, said locking means can include a first tubular sheath with axis parallel to the axis of the shell extending in the extension of the central zone of a first longitudinal edge, a second and a third tubular sheath with axes parallel to the axis of the shell extending in the extension of the second longitudinal edge on either side of a central zone with length at least equivalent to the central zone of the first longitudinal edge, and an axis designed to be capable of being engaged through the first, second and third sheaths being aligned in the closed position of said shell.

According to another embodiment variant, the locking means include at least one resilient ring designed to be capable of being housed in at least one annular groove extending on the outer face of the shell formed from the two half-shells.

The invention also provides that in some cases, said sleeve can include two half-shells each having a semi-cylindrical central portion bordered by two collars.

The latter can then each have complementary nesting means of a collar of a first half-shell with a collar of a second half-shell.

The collars can also each be provided with a groove with axis parallel to the half-shell and aligned with that of the groove of the other collar.

Furthermore, the present invention provides that the number n of turns formed by the helical furrow of said sleeve is between 1 and 100, and preferably equal to 15.

Furthermore, the sleeve is preferably made from polypropylene, or from a conventional material generally used in the industry and having equivalent properties.

One additional feature of the device according to the invention is further defined by the fact that the electricity source is designed to be capable of delivering an alternating current having a frequency of between 501 kHz and 4 MHz, and preferably equal to 600 kHz.

Other features and advantages of the invention will emerge from the following detailed description relative to several exemplary embodiments of the device according to the invention, given solely for information and non-limitingly.

BRIEF DESCRIPTION OF THE SEVERAL VIEWS OF THE DRAWINGS

The understanding of this description will be facilitated in reference to the attached drawings.

DETAILED DESCRIPTION OF THE INVENTION

Figure 1:
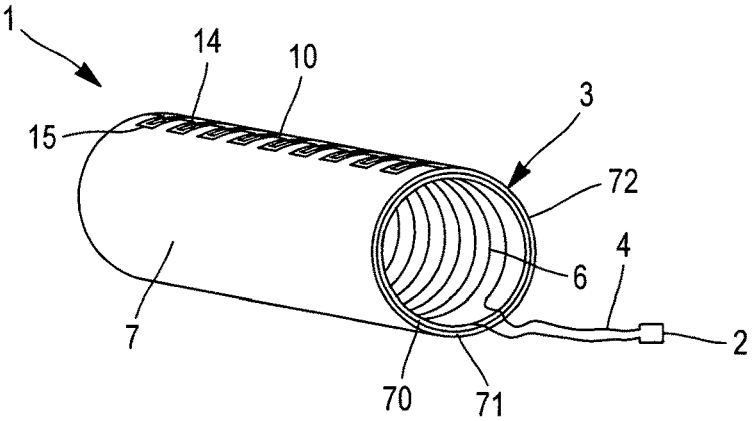
FIG. 1 illustrates a perspective view of an induction member of the device according to the invention, in which said sleeve and said shell include a longitudinal slit and a bending line so as to be able to adopt a position in which the opposite edges are separated and a position in which the opposite edges are close together.
Figure 2:
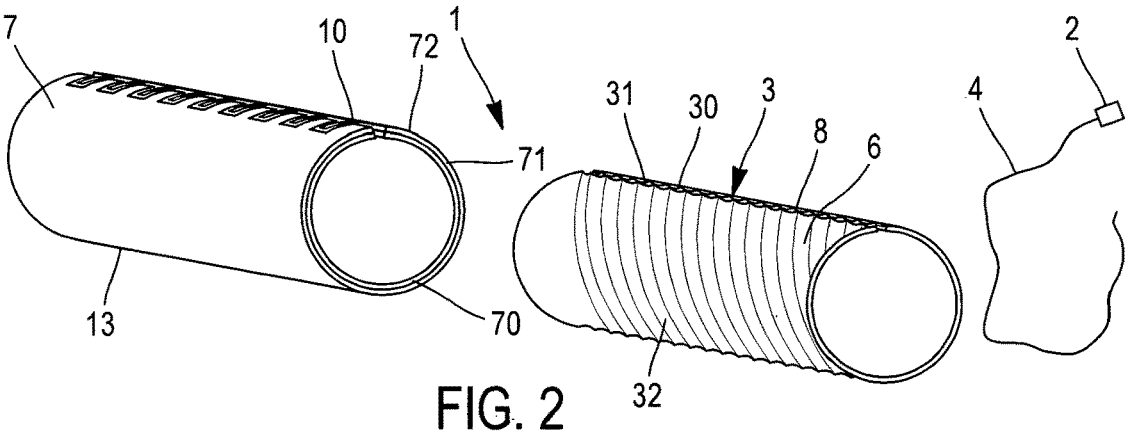
FIG. 2 is an exploded perspective view of the induction member of FIG. 1.
Figure 3:
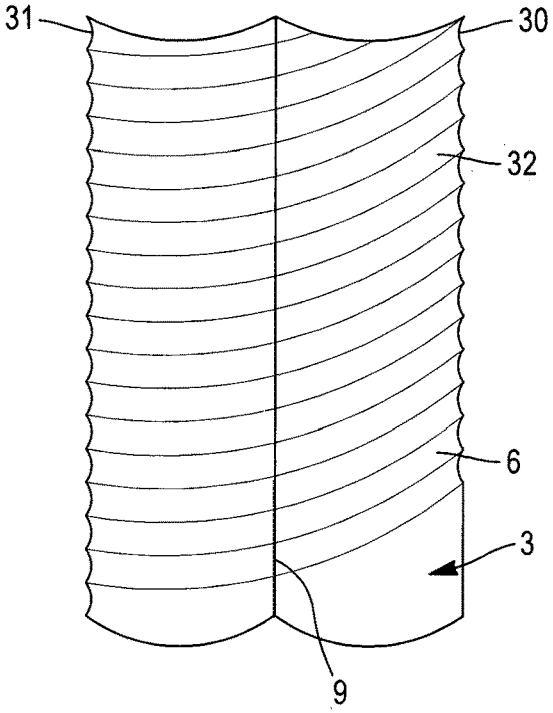
FIGS. 3 and 4 correspond to schematic views in the open position respectively of the sleeve and the shell included by the induction member of FIG. 1.
Figure 4:
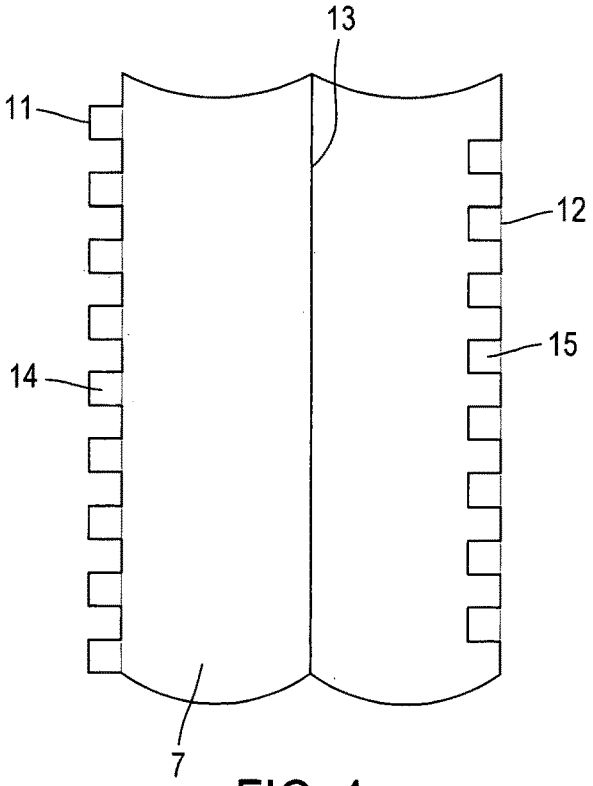

In the embodiment variant illustrated in FIGS. 1 to 5, the device for reducing the fuel consumption of a heat engine according to the invention includes an induction member 1, substantially tubular in shape, intended to be mounted around a pipe 5 made from a nonmagnetic material such as plastic, in which fuel circulates. Conventionally, the induction member 1 is able to create, from an alternating current received from an electricity source to which it is connected via a connector 2, an electromagnetic field at said pipe 5. This electromagnetic field results in inducing a change in the properties of the fuel circulating in the pipe 5 and obtaining an enhancement of the performance of the heat engine that is supplied therewith.

According to the invention, in the embodiment variant illustrated in FIGS. 1 to 5, the induction member 1 is made up of a sleeve 3, for example made from polypropylene, or any other conventional material commonly used in the industry having equivalent properties, and around which a wire coil 4 is arranged that is intended to be connected to the electricity source using the connector 2, as well as a tubular shell 7, designed to be capable of ensuring compliance with the standards on electromagnetic compatibility by said device, and the structure of which will be described in more detail below.

Figure 7:
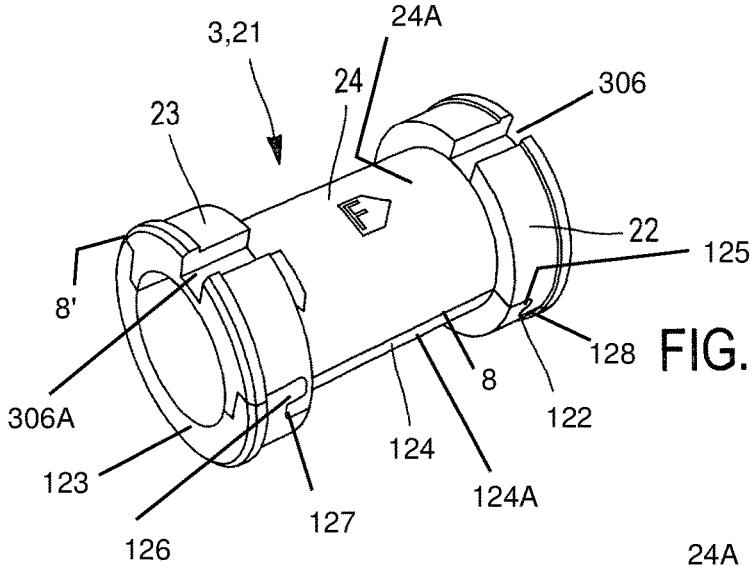
FIG. 7 shows a perspective view of another embodiment variant of a sleeve of the induction member of the device according to the invention including two half-shells.

The sleeve 3 is provided with a longitudinal slit 8 (at least one first half-shell longitudinal slit 8 and another first half-shell longitudinal slit 8' in the embodiment of FIG. 7) and a longitudinal slot extending across from said slit 8 and defining a bending line 9. Owing to such a structure, the sleeve 3 can adopt an open position (FIG. 3) in which its opposite edges 30, 31 are separated and a closed position (FIG. 2) in which its opposite edges 30, 31 are close together.

Furthermore, the sleeve 3 can be provided to be completely smooth. However, in the illustrated example, it is advantageously provided with a helical furrow 6, hollowed out along its outer face 32, and forming fifteen turns regularly spaced apart, in each of which a loop of the wire coil 4 can be housed. In this regard, it is specified that a different number of turns can be considered, preferably chosen on a case-by-case basis based on the type of vehicle to be equipped.

Preferably, such a helical furrow 6 is configured such that when the wire coil 4 is positioned around the sleeve 3, its various component loops are in contact with one another, while closely gripping the pipe 5 without risk of untimely moving, which would be detrimental to the effectiveness of the device according to the invention during its implementation. Thus, the helical furrow 6 defines a guide making it possible to facilitate the positioning of the wire coil 4 around the sleeve 3 by an operator, and therefore to ensure a suitable performance of this operation. Its presence also makes it possible to guarantee a maintenance in position of the wire coil 4 around the sleeve 3 during the implementation of the device according to the invention.

It should also be noted that in the illustrated embodiment variant, the tubular shell 7 also has a longitudinal slit 10 delimiting two longitudinal edges 11, 12 as well as a longitudinal slot extending across from said slit 10 (a first tubular half-shell longitudinal slit 10 in the embodiment corresponding to FIG. 7) and defining a bending line 13, such that it can adopt an open position (FIG. 4) in which its opposite edges 11, 12 are separated and a closed position (FIG. 2) in which its opposite edges 11, 12 are close together. Furthermore, the longitudinal edges 11, 12 of the shell 7 are advantageously configured so as to have complementary nesting means 14, 15 making it possible to ensure a locking in the closed position of the device according to the invention when it is mounted on a pipe 5.

Furthermore, the shell 7 comprises an inner enclosure 70 made from a flexible plastic material such as a polyurethane foam, an outer enclosure 71 made from a rigid plastic material, as well as an aluminum ring 72 extending between said inner 70 and outer 71 enclosures.

It should be noted that the inner enclosure 70 of the shell 7 can include, on its face oriented toward the sleeve 3, a helical furrow configured so as to be able to marry the loops of the wire coil 4 arranged on said sleeve 3. The presence of such a helical furrow makes it possible to improve the nesting of the set of component elements of the induction member 1.

In the illustrated embodiment variant, the sleeve 3 and the shell 7 are defined by monobloc parts each provided with a slit 8, 10 defining two edges 30, 31, 11, 12 able to be separated from and brought closer to one another during the installation of the induction member 1 on a pipe 5.

However, the invention also provides the possibility of making each of these two elements in the form of two independent parts, capable of being positioned against one another around a pipe 5, then assembled to make up the sleeve and the shell of the induction member.

Figure 6:
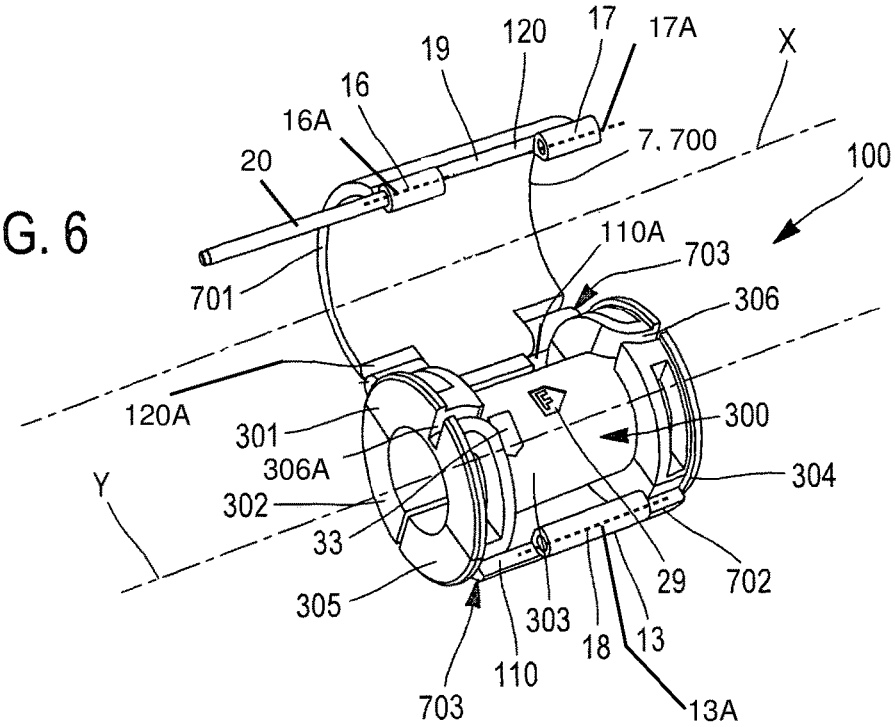
FIG. 6 shows a perspective view of another embodiment variant of the exploded member of the device according to the invention, the shell of which is in the open position, and which is devoid of the wire coil.

An induction member 100 including an example sleeve 300, 21 and shell 700 satisfying such a structure is illustrated in FIG. 6 and FIG. 7.

More specifically, the sleeve 300 is formed here by two identical half-shells 301, 302 each having a semi-cylindrical central portion 303 bordered by two collars 304, 305. The latter each advantageously include a groove 306, with axis parallel to the axis Y of the half-shells 301, 302 and aligned with that of the groove 306 (first sleeve end groove 306, first sleeve opposite end groove 306A) of the other collar 304, 305. Indeed, each groove 306 makes it possible to house and therefore guide the end strands of a wire coil 4 arranged around the sleeve 300, which makes it possible to avoid any untimely deterioration thereof. Furthermore, the sleeve 300 is advantageously provided with signaling means indicating to an operator the direction in which the wire coil must be placed in light of the direction in which the fuel circulates between the tank and the engine. These signaling means are defined here by two arrows 29, 33 respectively embodying the circulation direction of the fuel and the winding direction of the wire around the sleeve 300.

Furthermore, the tubular shell 700 included by the induction member 100 is formed by two half-shells 701, 702. Each of them has a longitudinal edge 110 and a longitudinal edge 120 that are intended to cooperate respectively with the longitudinal edge 120 and the longitudinal edge 110 of the other half-shell using two hinges 703. The first tubular half-shell 701 has a first shell longitudinal edge 120 with a first tubular half-shell central zone 19, and a first shell hinged edge 120A. The second tubular half-shell 702 has a second shell longitudinal edge 110 with a second tubular half-shell central zone 18. As illustrated in FIG. 6, the latter include a first tubular sheath 13, with axis parallel to the axis X of the shell 700, extending in the extension of a central zone 18 of the longitudinal edge 110 of each half-shell 701, 702, a second and a third tubular sheath 16, 17, with axes parallel to the axis X of the shell 700, extending in the extension of the longitudinal edge 120 of the half-shell 700, on either side of a central zone 19 with length at least equivalent to the central zone 18 of the first longitudinal edge 110. The hinges 703 further include an axis 20, which is designed to be capable of being engaged through the first, second and third sheaths 13, 16, 17 when they are aligned in the closed position of said shell 700. The first shell longitudinal edge 120 is comprised of a first shell nesting means (second tubular sheath 16 a second tubular sheath axis 16A and third tubular sheath 17 third tubular sheath axis 17A). The second shell longitudinal edge 110 is comprised of a second shell nesting means (first tubular sheath 13 first tubular sheath axis 13A).

It should be noted that such a hinge 703 also allows the axis rod 20, housed in the sheaths 13, 16, 17, to act as means for locking in the closed position of the shell 700, while preventing any untimely opening. Furthermore, to open a shell 700, it suffices to remove one of the two axes 20 from one of the two hinges 703 of the sheaths 13, 16, 17, then to separate the corresponding longitudinal edges 110, 120, by pivoting of the two half-shells 701, 703 around the axis 20 having remained housed in the sheaths 13, 16, 17 of the other hinge 703.

In order to illustrate different features of the present invention, a sleeve 21 according to an additional embodiment variant has been shown in FIG. 7. The sleeve 21 includes a first sleeve half-shell 24 having a first sleeve semi-cylindrical central portion 24A, a first sleeve end collar 22, and a first sleeve opposite end collar 23, and a second sleeve half-shell 124 having a second sleeve semi-cylindrical central portion 124A, a second sleeve end collar 122, and a second sleeve opposite end collar 123.

Figure 8:
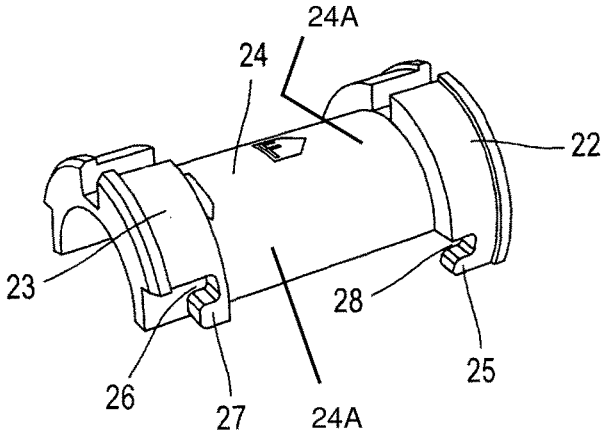
FIG. 8 illustrates a perspective view of the half-shell of the sleeve of FIG. 7.

It differs from the sleeve 300 visible in FIG. 6 in that the collars 22, 23 with which its component identical half-shells 24 are provided (cf. FIG. 8) are provided, have complementary nesting means. For each half-shell 24, the latter are defined here by tabs 25, 27 and indentations 26, 28 intended to cooperate respectively with the indentations 26, 28 and the tabs 25, 27 of another half-shell 24 placed head-to-tail relative to the first (cf. FIG. 7). A first sleeve end nesting means comprises a first sleeve end nesting tab 25 and first sleeve end nesting indentation 28. A first sleeve opposite end nesting means comprises a first sleeve opposite end nesting tab 27 and a first sleeve opposite end nesting indentation 26. A second sleeve end nesting means comprises a second sleeve end nesting tab 125 and a second sleeve end nesting indentation 128. A second sleeve opposite end nesting means includes a second sleeve opposite end nesting tab 127, and a second sleeve opposite end nesting indentation 126.

Figure 5:
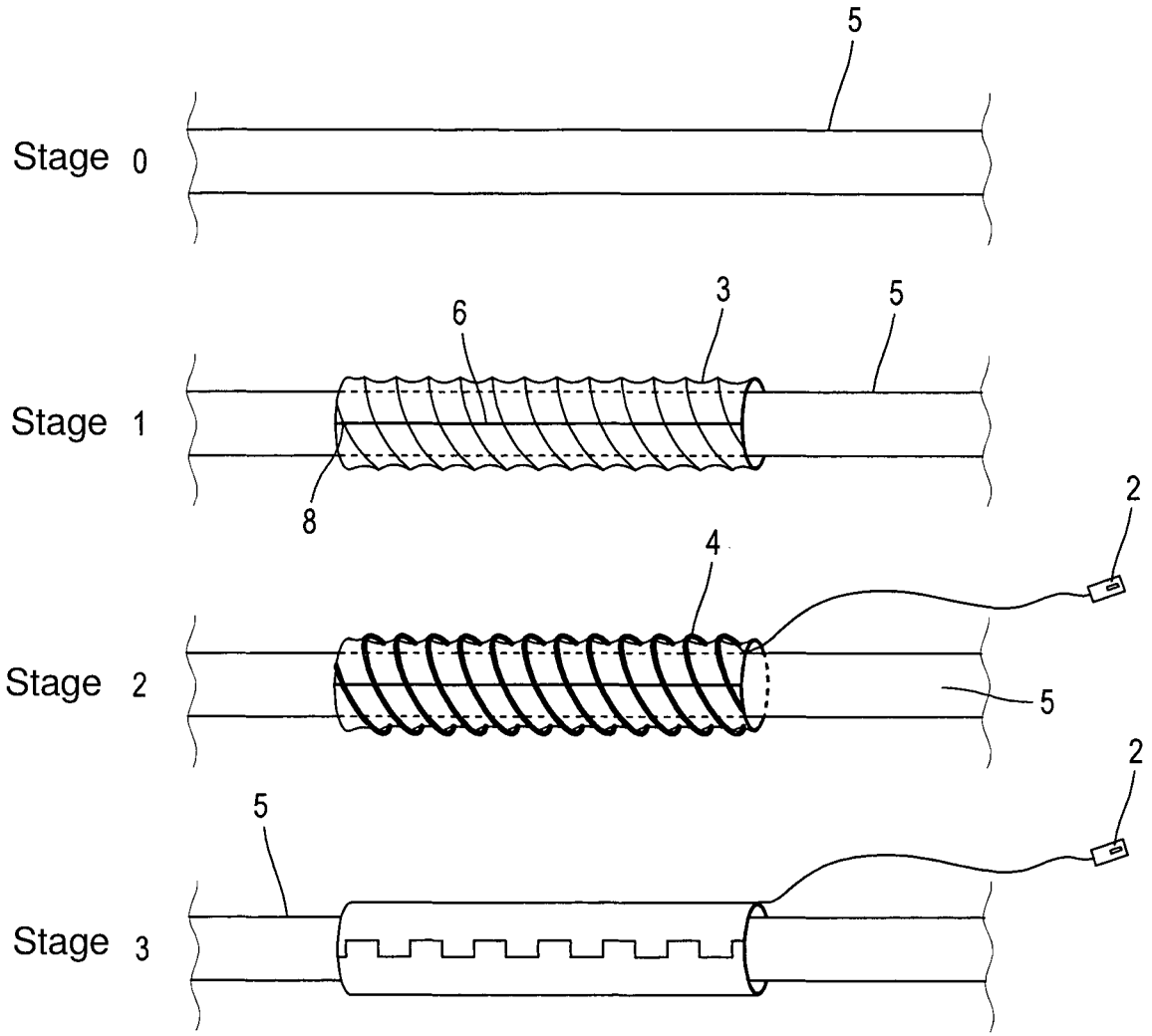
FIG. 5 corresponds to a schematic view of an illustration of the different steps of the installation of the induction member of FIG. 1 on a fuel pipe.

The installation, on a fuel pipe 5 of an engine compartment of a vehicle, of a device according to the invention including an induction module 1 having the structure illustrated in FIGS. 1 to 5 is done quickly, effectively and lastingly by carrying out the three steps illustrated in FIG. 5 and which assume the following operations, having specified that the dimensions of the induction member, and therefore of its component elements, are chosen such that it is fitted relative to the pipe 5 after its complete installation:

step 1: After placing the sleeve 3 in its open position, the latter is arranged around the pipe 5, then closed, step 2: the wire coil 4 is arranged around the sleeve 5 by placing its loops one after the other in each of the turns of the helical furrow 6, step 3: After placing the shell 4 in its open position, the latter is arranged around the sleeve 3 bearing the wire coil 4, then closed. To finish, the connector 2 is connected to an electricity source is designed to be capable of delivering an alternating current having a frequency of between 501 kHz and 4 MHz, preferably equal to 600 kHz.

Several tests were done in order to verify the effectiveness of the device according to the invention regarding the decreased fuel consumption of a motor vehicle.

Thus, a first test was done by installing a device according to the invention on a fuel pipe of the engine compartment of a car equipped with a heat engine of the mechanical management on diesel type. The obtained results made it possible to note that the average fuel consumption of this vehicle went from 9.7 l/100 km to 6.1 l/100 km, which corresponds to a fuel savings of about 37.11%.

A second test was done by installing a device according to the invention on a fuel pipe of the engine compartment of a van equipped with a heat engine of the electronic management on diesel type. The obtained results made it possible to note that the average fuel consumption of this vehicle went from 13.5 l/100 km to 9.3 l/100 km, which corresponds to a fuel savings of about 31.11%.

A third test was done by installing a device according to the invention on a fuel pipe of the engine compartment of a tractor equipped with an engine of the electronic management type supplied with cold-resistant diesel ("GNR −25° C."). The obtained results made it possible to note that the average fuel consumption of this vehicle went from 45.65 l/Hour to 39.25 l/Hour, which corresponds to a fuel savings of about 14%.

As a result, the preceding shows that the present invention makes it possible to achieve the aims set out in the preamble, by proposing a device for reducing the fuel consumption of a heat engine that has a simple, easy to install, reliable and effective structure with many types of engines, fuels and vehicles. This device also has the advantage of being non-intrusive for the engine. As a result, it does not require any modification or replacement of the mechanical members of the original engine installed by the builder, or any procedure or modification of the electronic parameters of this engine. Furthermore, certain embodiment variants advantageously have a structure such that the device according to the invention is removable, has an accessory nature, and if applicable allows disassembly from one vehicle for installation on another.

I claim:

1. A device for reducing fuel consumption of a heat engine, comprising:

an induction member having a tubular shape so as to be mountable around a pipe with circulating fuel therein; and an electricity source being connected to said induction member so as to provide alternating current to said induction member for an electromagnetic field within said induction member, wherein said induction member comprises:

a sleeve;

at least one wire coil being around said sleeve;

a connector attached to said at least one wire coil and connected to said electricity source, said at least one wire coil being connected to said electricity source through said connector; and a tubular shell, said sleeve being housed in said tubular shell, wherein said sleeve comprises:

a first sleeve half-shell having a first sleeve semi-cylindrical central portion, a first sleeve end collar, and a first sleeve opposite end collar, said first sleeve semi-cylindrical central portion being between said first sleeve end collar and said first sleeve opposite end collar; and a second sleeve half-shell having a second sleeve semi-cylindrical central portion, a second sleeve end collar, and a second sleeve opposite end collar, said second sleeve semi-cylindrical central portion being between said second sleeve end collar and said second sleeve opposite end collar, said first sleeve half-shell being removably attached to said second sleeve half-shell so as to define a first half-shell closed position with at least one first half-shell longitudinal slit and a first half shell opened position with said first sleeve half-shell separated from said second sleeve half-shell, and wherein said tubular shell comprises:

a first tubular half-shell having a first shell longitudinal edge with a first tubular half-shell central zone, and a first shell hinged edge; and a second tubular half-shell having a second shell longitudinal edge with a second tubular half-shell central zone, and a second shell hinged edge, said first tubular half-shell being hingedly attached to said second tubular half-shell so as to define a first tubular half-shell closed position with a first tubular half-shell longitudinal slit and a first tubular half-shell opened position with said first sleeve half-shell separated from said second sleeve half-shell, said first tubular half-shell central zone being aligned with said second tubular half-shell central zone in the first tubular half-shell closed position.

2. The device according to claim 1, further comprising:

a hinge connecting said first shell hinged edge and said second shell hinged edge.

3. The device according to claim 1, wherein said first shell longitudinal edge is comprised of a first shell nesting means, wherein said second shell longitudinal edge is comprised of a second shell nesting means, said first shell nesting means being complementary to said second shell nesting means so as to removably attach said first shell longitudinal edge to said second shell longitudinal edge and define the first tubular half-shell closed position with the first tubular half-shell longitudinal slit and the first tubular half shell opened position with said first shell longitudinal edge separated from said second shell longitudinal edge.

4. The device according to claim 1, wherein said shell further comprises a locking means for the first tubular half-shell closed position.

5. The device according to claim 4, wherein said second shell nesting means comprises:

a first tubular sheath having a first tubular sheath axis parallel to an axis of said shell and placed in said second tubular half-shell central zone of said second shell longitudinal edge, wherein said first shell nesting means comprises:

a second tubular sheath with a second tubular sheath axis parallel to the axis of said shell and placed laterally from said first tubular half-shell central zone; and a third tubular sheath with a third tubular sheath axis parallel to the axis of said shell and placed laterally from said first tubular half-shell central zone opposite said second tubular sheath, said first tubular sheath axis, said second tubular sheath axis, and said third tubular sheath axis being aligned in said first tubular half-shell closed position, and wherein the locking means comprises an axis rod extending through said first tubular sheath, said second tubular sheath, and said third tubular sheath in said first tubular half-shell closed position.

6. The device according to claim 1, wherein said first sleeve end collar is comprised of a first sleeve end nesting means, wherein said first sleeve opposite end collar is comprised of a first sleeve opposite end nesting means, wherein said second sleeve end collar is comprised of a second sleeve end nesting means, wherein said second sleeve opposite end collar is comprised of a second sleeve opposite end nesting means, said first sleeve end nesting means being complementary to said second sleeve end nesting means and said first sleeve opposite end nesting means being complementary to said second sleeve opposite end nesting means so as to removably attach said first sleeve half-shell to said second sleeve half-shell and define the first half-shell closed position with the at least one first half-shell longitudinal slit and another first half-shell longitudinal slit and the first half shell opened position with said first sleeve half-shell separated from said second sleeve half-shell.

7. The device according to claim 1, wherein said first sleeve end collar is comprised of a first sleeve end groove being parallel to a first sleeve half-shell longitudinal axis of said first sleeve half-shell, wherein said first sleeve opposite end collar is comprised of a first sleeve opposite end groove being parallel to the first sleeve half-shell longitudinal axis of said first sleeve half-shell, said first sleeve end groove being aligned with said first sleeve opposite end groove.

8. The device according to claim 1, wherein said sleeve is comprised of polypropylene.

* * * * *